US005984215A

United States Patent [19]

Huang

[11] Patent Number: 5,984,215

[45] Date of Patent: Nov. 16, 1999

[54] PAPER FEEDING SENSOR OF PAPER SHREDDER

[76] Inventor: Li-Ming Wu Huang, 3F, No. 29, Lane 80, Sec. 1, DWU HWU S. Road, Taipei, Taiwan

[21] Appl. No.: 09/010,572

[22] Filed: Jan. 22, 1998

[51] Int. Cl.[6] ..... B02C 25/00

[52] U.S. Cl. ..... 241/36; 241/236

[58] Field of Search ..... 241/34, 36, 100, 241/236

[56] References Cited

U.S. PATENT DOCUMENTS 4,842,205 6/1989 Araki et al. ..... 241/34

5,167,374 12/1992 Strohmeter ..... 241/36

5,775,605 7/1998 Tsai ..... 241/36

*Primary Examiner*—Mark Rosenbaum

*Attorney, Agent, or Firm*—Browdy and Neimark

[57] ABSTRACT

A paper feeding sensor mounted in the paper shredder is composed of a microswitch and a detection rod capable of triggering the microswitch so as to actuate two cutters of the paper shredder. The detection rod is received in a receiving cell of the paper guiding grid plate of the paper shredder such that the detection rod is pushed to trigger the microswitch by a paper which is fed into the receiving cell of the paper guiding grid plate.

7 Claims, 4 Drawing Sheets

PAPER FEEDING SENSOR OF PAPER SHREDDER

FIELD OF THE INVENTION

The present invention relates generally to a paper shredder, and more particularly to a paper feeding sensor of the paper shredder.

BACKGROUND OF THE INVENTION

The conventional paper shredder is generally composed of a microswitch or LED (light-emitting diode) electronic eye located at the paper feeding port of the paper shredder. The paper shredder is started as soon as the microswitch or electronic eye has detected the feeding of the paper to be shredded. Such a conventional sensing device as described above is capable of sensing the feeding of paper as soon as the front edge of the paper has entered the paper feeding port, thereby triggering the shredding action of the paper shredder. On the other hand, the conventional sensing device ceases to function as soon as the rear edge of the paper has passed the sensing device, thereby resulting in an immediate termination of the shredding action of the paper shredder. As a result, the rear end of the paper remains intact. In order to overcome such an operational deficiency as described above, the conventional paper shredder is provided with a delay circuit capable of cooperating with the microswitch or LED electronic eye in such a way that the operation of the cutter of the paper shredder is prolonged for 2–3 seconds so as to ensure that the paper is shredded in its entirety. However, the addition of the delay circuit results in an increase in the cost of the paper shredder.

SUMMARY OF THE INVENTION

The primary objective of the present invention is therefore to provide a paper shredder with a paper feeding sensor free from the shortcomings of the conventional paper sensing devices.

In keeping with the principle of the present invention, the foregoing objective of the present invention is attained by the paper feeding sensor consisting of a microswitch and a detection rod. The microswitch is capable of transmitting a signal to trigger the operation of the cutter of the paper shredder. The detection rod has a connection section and a detection section. The connection section is located on a triggering arm of the microswitch such that the detection section is extended into a receiving cell of the paper guiding grid plate of the paper shredder, and that the lower end of the detection section is located at a level below that of the central axes of the two cutters. As paper is fed into the receiving cell of the paper guiding grid plate, the detection section of the detection rod is pushed by the paper to trigger the microswitch so as to start the operation of the cutters. As the paper travels passed the lower end of the detection section, the detection section of the detection rod is no longer being pushed by the paper so as to enable the detection rod to return to its original position, thereby resulting in a cessation of the operation of the microswitch.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
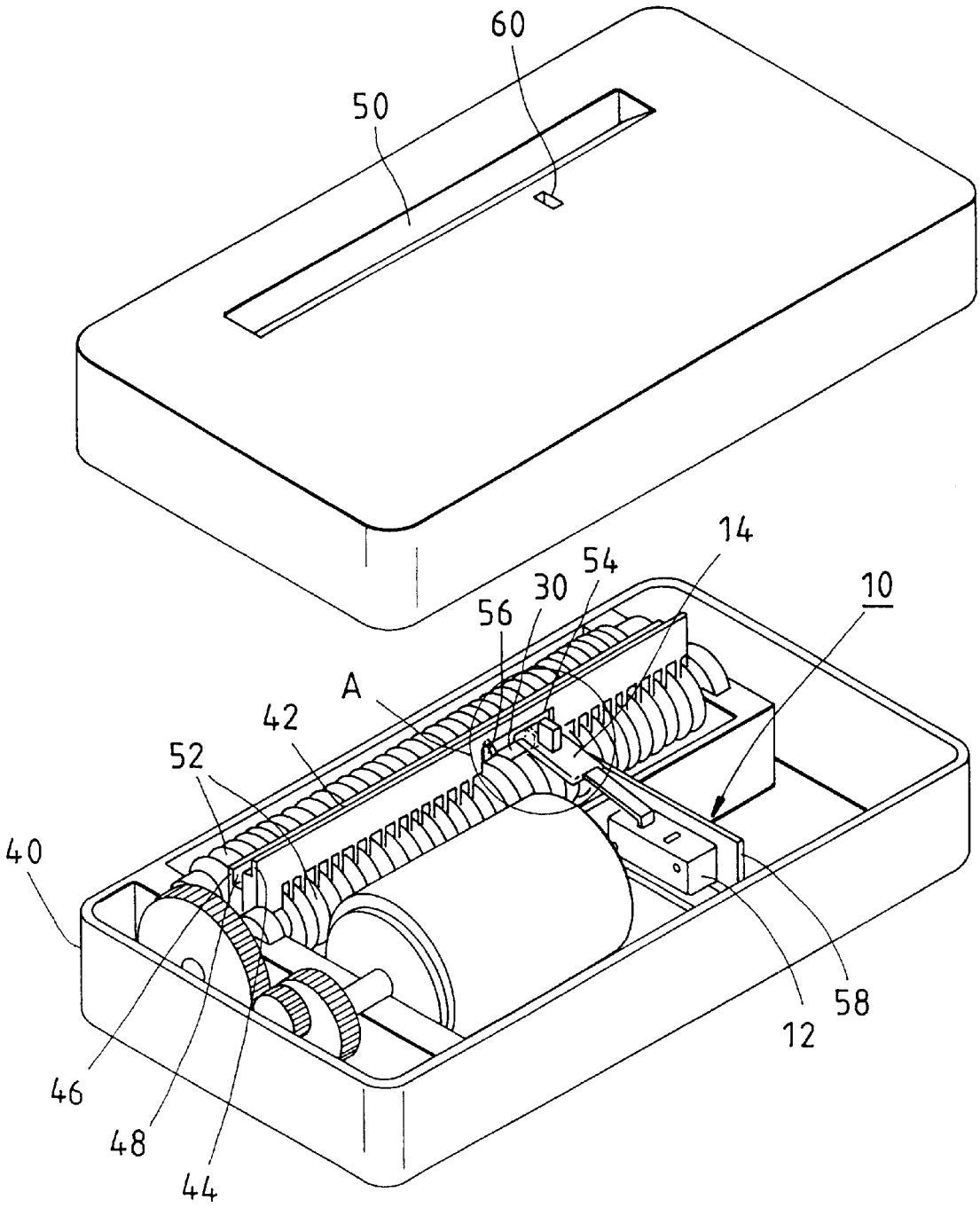
FIG. 1 shows a schematic view of the preferred embodiment of the present invention in combination with the machine base of a paper shredder.
Figure 2:
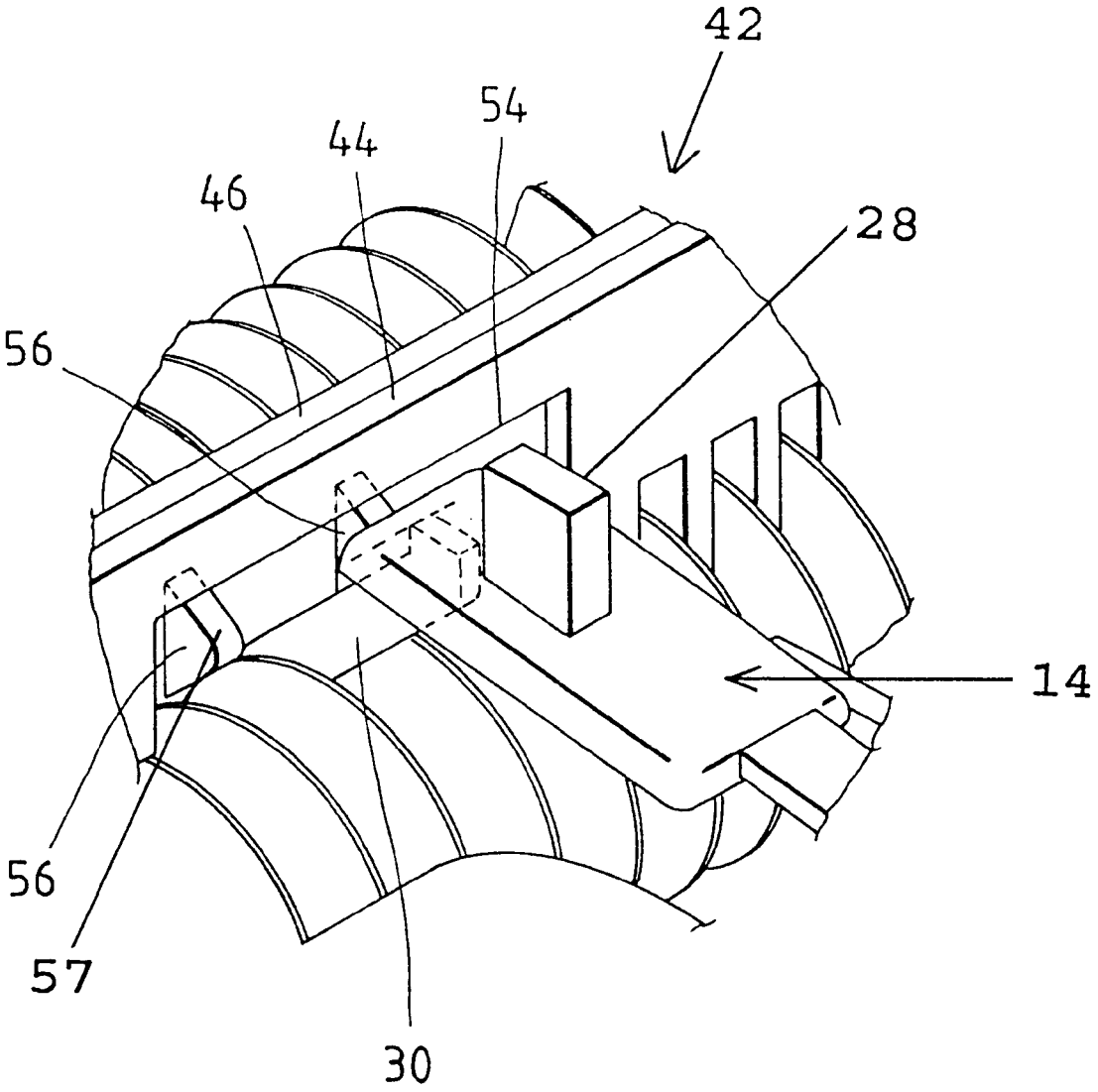
FIG. 2 shows an enlarged schematic view of a portion indicated by a circle "A" as shown in FIG. 1.

As shown in FIGS. 1 and 2, a paper feeding sensor 10 embodied in the present invention is mounted in one side of a paper guiding grid plate 42 of a machine base 40 of the paper shredder and is composed of a microswitch 12 and a detection rod 14.

The paper guiding grid plate 42 consists of a right side plate 44 and a left side plate 46, which are intended to form a receiving cell 48 having a top opening. The machine base 40 is provided with a paper feeding port 50 corresponding in location to the top opening of the receiving cell 48. The receiving cell 48 has a bottom opening corresponding in location to the junction of two cutters 52. The right side plate 44 is provided with a receiving portion 54 (a through port), whereas the left side plate 46 is provided with two guide portions 56 (protruded blocks) made integrally therewith such that the two guide portions 56 are corresponding in location to the receiving portion 54. Each of the guide portions 56 is provided with an inclined plane 57. The right side plate 44 is further provided with a frame 58 corresponding in location to the receiving portion 54.

The microswitch 12 is similar in construction to a conventional microswitch and is mounted on the frame 58. The microswitch 12 has a microbutton 22 and a detection arm 24 engaged over the microbutton 22. As the microbutton 22 is pressed by the detection bar 24, the microswitch 12 is triggered.

The detection rod 14 has a connection section 26 which is located at one end thereof on the detection arm 24 and is provided thereon with a press block 28. The detection rod 14 further has a detection section 30 provided with a bevel portion 31, vertical portion 32 extending from the bevel portion 31, and an arcuate surface 34. The detection rod 14 is received in the receiving portion 54 and the receiving cell 48 such that one end of the bevel portion 31 is located between the two guide portions 56, and that lower end of the vertical portion 32 is corresponding in location to the end point A1 located below the respective central axes 20, 21 of the two cutters 52, and further that the press block 28 is jutted out of the machine base 40 via a through hole 60 of the machine base 40.

Figure 3:
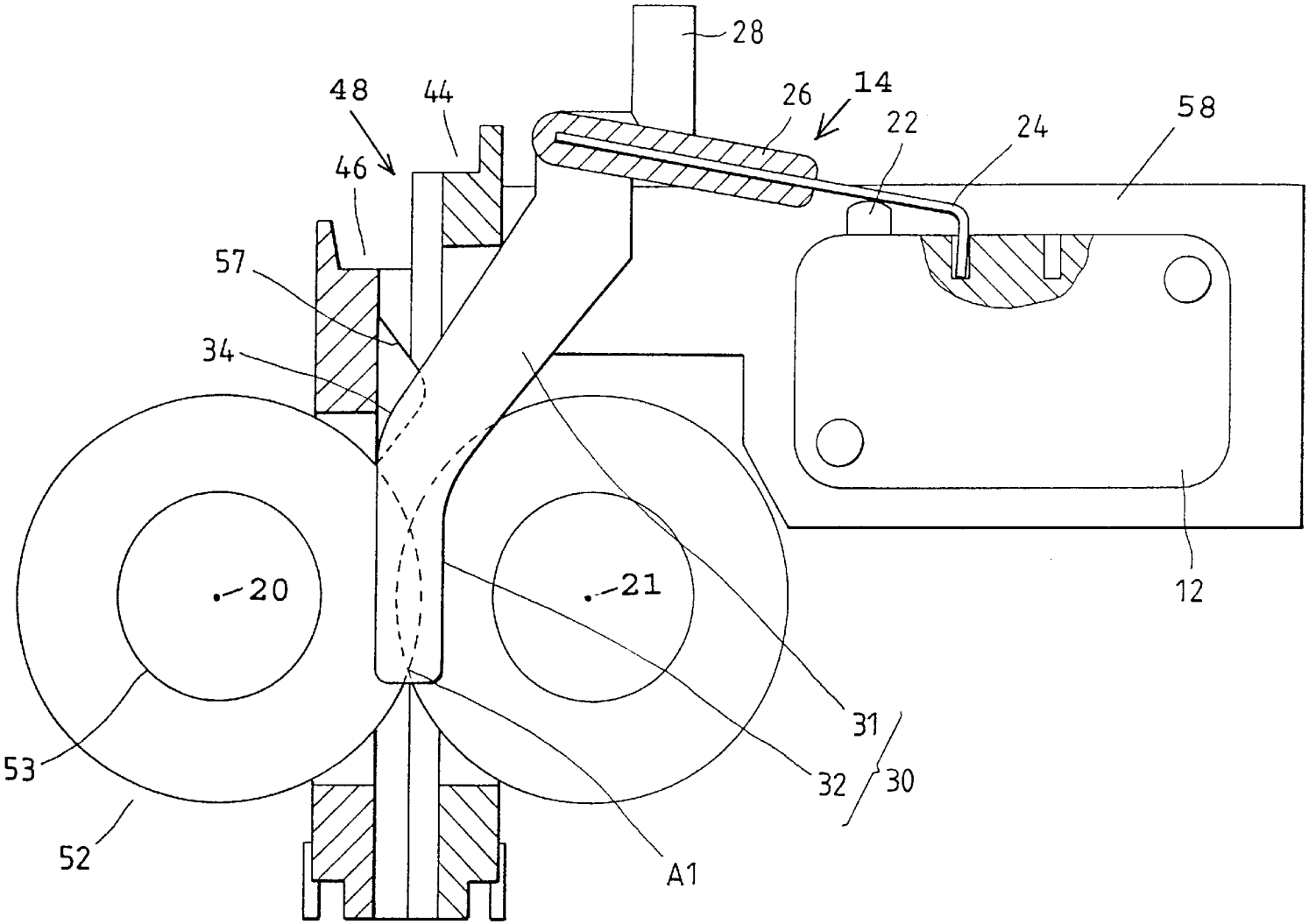
FIG. 3 shows a schematic view of the present invention at work.
Figure 4:
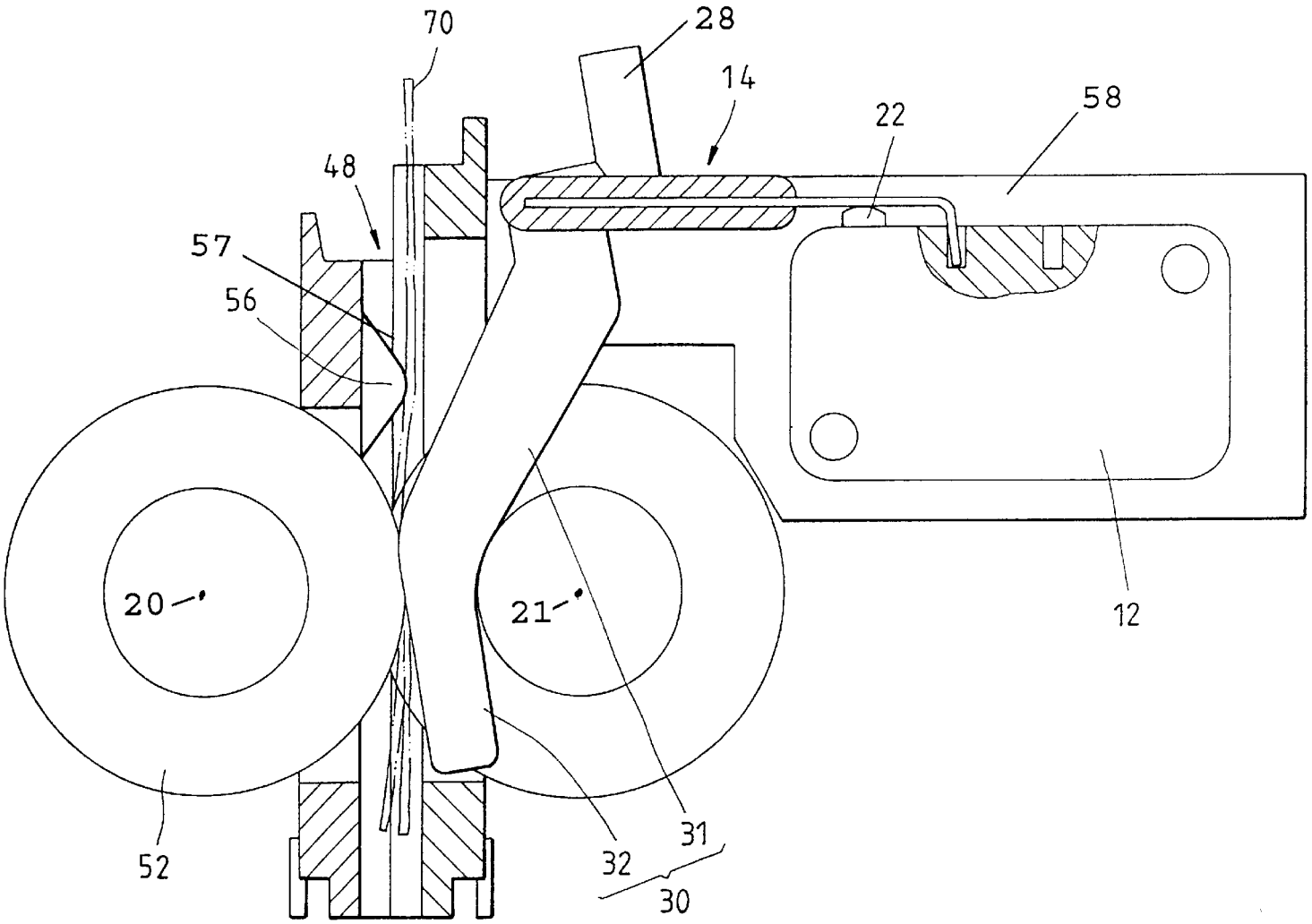
FIG. 4 shows another schematic view of the present invention at work.

As illustrated in FIG. 3, the vertical portion 32 is located at the center of the gap between the rotary shafts 53 of the two cutters 52 before a paper 70 is fed into the paper feeding port 50. Now referring to FIG. 4, when the paper 70 is fed into the receiving cell 48 via the paper feeding port 50, the paper 70 is then caused to slide along the inclined plane 57 of the guide portion 56 to arrive at the bevel portion 31. The detection rod 14 is forced by the paper 70 in motion to displace counterclockwise so as to trigger the microswitch 12, thereby resulting in the activation of the shredding of the paper 70 by the two cutters 52. As the top edge of the paper 70 passes the lower end of the vertical portion 32, the detection rod 14 is relieved of the pushing force of the paper 70, thereby enabling the microbutton 22 to be ejected to result in the operational interruption of the cutters 52.

In the event that the rear end of the paper 70 is not shredded, a remedial measure may be taken by pressing the press block 28 to cause the detection rod 14 to displace counterclockwise so as to trigger the microswitch 12. As a result, the cutters 52 are kept operating until the paper 70 is completely shredded.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A paper feeding sensor engaged on one side of a paper guiding grid plate of a paper shredder and composed of a microswitch having a detection arm and capable of transmitting a signal to actuate two cutters of the paper shredder, said paper feeding sensor further composed of a detection rod having a connection section mounted on said detection arm of said microswitch, and a detection section extending obliquely from said connection section such that a lower end of said detection section is located at a level below that of a respective central axis of each of the two cutters of the paper shredder, whereby said detection rod located in a receiving cell of the paper guiding grid plate of the paper shredder is caused to displace to trigger said microswitch at such time when said detection section of said detection rod is pushed by a paper fed into the receiving cell of the paper guiding grid plate of the paper shredder; whereby said detection rod is capable of returning to an original position thereof after being displaced at such time when the paper completely passes the lower end of said detection section, thereby resulting in a operational interruption of said microswitch.

2. The paper feeding sensor as defined in claim 1, wherein said connection section of said detection rod is provided with a press block made integrally therewith for reactivating said detection rod.

3. The paper feeding sensor as defined in claim 2, wherein said press block juts out of a base of the paper shredder via a through hole of the base of the paper shredder.

4. The paper feeding sensor as defined in claim 1, wherein said detection section of said detection rod has a bevel portion and a vertical portion extending from said bevel portion.

5. The paper feeding sensor as defined in claim 4, wherein said bevel portion and said vertical portion are provided at a junction thereof with an arcuate surface.

6. The paper feeding sensor as defined in claim 4, wherein said bevel portion has one end which is located between two guide portions of the paper guiding grid plate of the paper shredder.

7. The paper feeding sensor as defined in claim 1, wherein said detection rod is provided with an arcuate surface corresponding in location to the receiving cell of the paper guiding grid plate of the paper shredder.

* * * * *